US010877397B1

(12) United States Patent
Yoshihira

(10) Patent No.: US 10,877,397 B1
(45) Date of Patent: Dec. 29, 2020

(54) DEVELOPER STORAGE LEVEL DETECTING DEVICE, DEVELOPER SUPPLYING DEVICE, AND IMAGE FORMING APPARATUS

(71) Applicant: FUJI XEROX CO., LTD., Tokyo (JP)

(72) Inventor: Yuki Yoshihira, Kanagawa (JP)

(73) Assignee: FUJI XEROX CO.. LTD., Tokyo (JP)

( * ) Notice: Subject to any disclaimer, the term of this patent is extended or adjusted under 35 U.S.C. 154(b) by 0 days.

(21) Appl. No.: 16/750,450

(22) Filed: Jan. 23, 2020

(30) Foreign Application Priority Data

Sep. 25, 2019 (JP) ..... 2019-174349

(51) Int. Cl.
*G03G 15/08* (2006.01)

(52) U.S. Cl.
CPC . *G03G 15/0858* (2013.01); *G03G 2215/0634* (2013.01)

(58) Field of Classification Search
CPC ..... G03G 15/0858
USPC ..... 399/27, 61
See application file for complete search history.

(56) References Cited

U.S. PATENT DOCUMENTS 5,923,918 A * 7/1999 Nakagawa et al. ..... G03G 15/0858 399/27
6,041,196 A * 3/2000 Nakagawa et al. ..... G03G 15/0858 399/27
6,330,402 B1 * 12/2001 Sakurai et al. .... G03G 15/0858 399/27
7,965,952 B2 * 6/2011 Tan et al. ..... G03G 15/553 399/27
9,020,375 B2 * 4/2015 Kinoshita et al. ..... G03G 15/0858 399/27

FOREIGN PATENT DOCUMENTS

JP 2016-48359 A 4/2016
JP 2016-151634 A 8/2016

* cited by examiner

*Primary Examiner* — William J Royer
(74) *Attorney, Agent, or Firm* — Sughrue Mion, PLLC

(57) ABSTRACT

A developer storage level detecting device includes: a main body having a transporting path through which a developer is transported; a developer transporting unit that is disposed to rotate in the transporting path and has a transporting section provided spirally around a rotating shaft; a swingable member that comes in contact with a surface of the developer being transported in the transporting path and swings while following at least a level of the surface of the developer stored; and a detecting unit that detects a swing state of the swingable member, wherein the transporting unit has a non-transporting section without the transporting section, and the swingable member is disposed to swing in the non-transporting section.

12 Claims, 11 Drawing Sheets

DEVELOPER STORAGE LEVEL DETECTING DEVICE, DEVELOPER SUPPLYING DEVICE, AND IMAGE FORMING APPARATUS

CROSS-REFERENCE TO RELATED APPLICATIONS

This application is based on and claims priority under 35 USC 119 from Japanese Patent Application No. 2019-174349 filed Sep. 25, 2019.

BACKGROUND

(i) Technical Field

The present disclosure relates to a developer storage level detecting device, a supplying device, and an image forming apparatus.

(ii) Related Art

Examples of the related art include JP-A-2016-151634 and JP-A-2016-48359 which disclose techniques for detecting the surface level of a stored developer (storage level).

JP-A-2016-151634 discloses a technology in which in a sub hopper (toner storage unit) that is disposed below a toner bottle detachably mounted and that stores a developer supplied from the toner bottle and supplies the stored developer to a developing device by driving a supply roller, a float member that detects an upper surface level of a toner is provided so as to freely swing about a shaft, and a light shielding plate that is attached to the shaft and swings up and down as the float member swings and is detected by a transmission type photosensor is provided.

JP-A-2016-151634 (paragraphs 0039 to 0062, FIGS. 3 to 10, and the like) discloses that a float member swings up and down by a cam that rotates with a stirring shaft disposed below the float member, and even if the amount of toner in the sub hopper is reduced, the sub hopper swings up and down so as not to collide with a stirring plate for leveling the upper surface of the toner provided on the stirring shaft. JP-A-2016-151634 further discloses that a state where the amount of toner in the sub hopper is reduced and the float member swings downward is detected by the transmission type photosensor through the light shielding plate, and when the number of times of the detection becomes a predetermined number or less, it is determined that the toner will soon be used up.

JP-A-2016-48359 (paragraphs 0032 to 0042 and 0053, FIGS. 3 to 6, and the like) discloses a technology of detecting the amount of toner having substantially the same structure as that disclosed in JP-A-2016-151634 except for the light shielding plate and the transmission type photosensor.

JP-A-2016-48359 discloses that a magnet is provided on the upper surface of the free end of a float member that swings to the upper limit in a sub hopper, an empty sensor that operates according to the position of the magnet is attached to the outer surface of the sub hopper, a state where the amount of the toner in the sub hopper is reduced and the float member swings downward is detected by the empty sensor through the magnet, and when the detection is performed, the toner is determined to be insufficient.

SUMMARY

Aspects of non-limiting embodiments of the present disclosure relate to providing a developer storage level detecting device capable of detecting the level of a stored developer storage level in a transporting path disposed so that a developer transporting unit having a spiral transporting section around a rotating shaft rotates, without providing an additional space for storing and detecting the developer separately from the transporting path, and to providing a developer supplying device and an image forming apparatus each including such a developer storage level detecting device.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to one aspect of the present disclosure, there is provided a developer storage level detecting device including: a main body having a transporting path through which a developer is transported; a developer transporting unit that is disposed to rotate in the transporting path and has a transporting section provided spirally around a rotating shaft; a swingable member that comes in contact with a surface of the developer being transported in the transporting path and swings while following at least a level of the surface of the developer stored; and a detecting unit that detects a swing state of the swingable member, wherein the transporting unit has a non-transporting section without the transporting section, and the swingable member is disposed to swing in the non-transporting section.

BRIEF DESCRIPTION OF THE DRAWINGS

Exemplary embodiments of the present invention will be described in detail based on the following figures, wherein:

FIG. 5A is a schematic sectional view illustrating a state when a swingable member swings to the highest position; and FIG. 5B is a schematic sectional view illustrating a state when the swingable member swings to the lowest position;

FIG. 9A is a schematic sectional view illustrating a state when a swingable member swings to the highest position; and FIG. 9(B) is a schematic sectional view illustrating a state when the swingable member swings to the lowest position;

FIG. 12A is a schematic sectional view illustrating a state when a swingable member swings to the highest position; and FIG. 12B is a schematic sectional view illustrating a state when the swingable member swings to the lowest position.

DETAILED DESCRIPTION

Hereinafter, exemplary embodiments for carrying out the present disclosure will be described with reference to the drawings.

First Exemplary Embodiment

Figure 1:
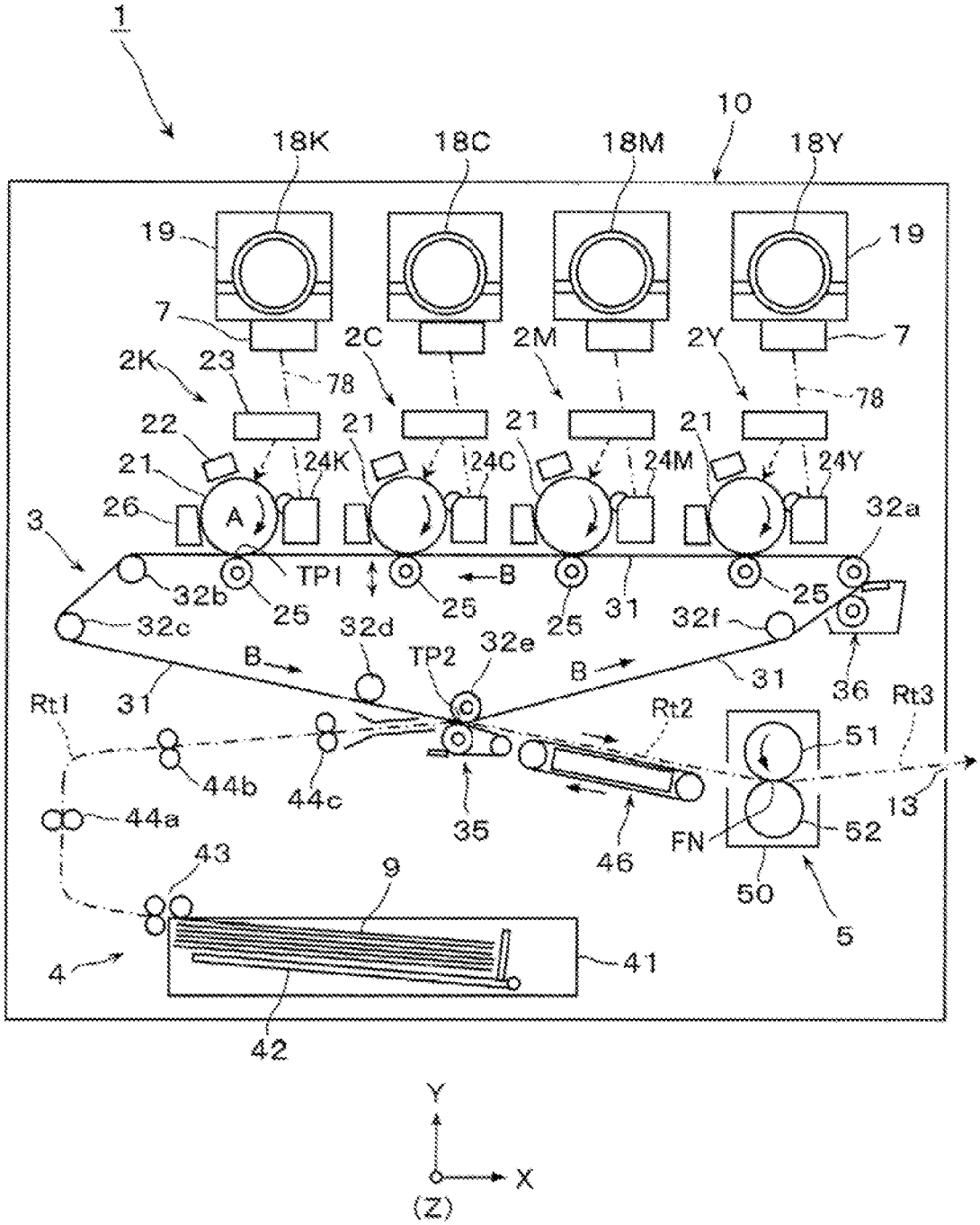
FIG. 1 is a schematic diagram illustrating an overall configuration of an image forming apparatus according to a first exemplary embodiment.
Figure 2:
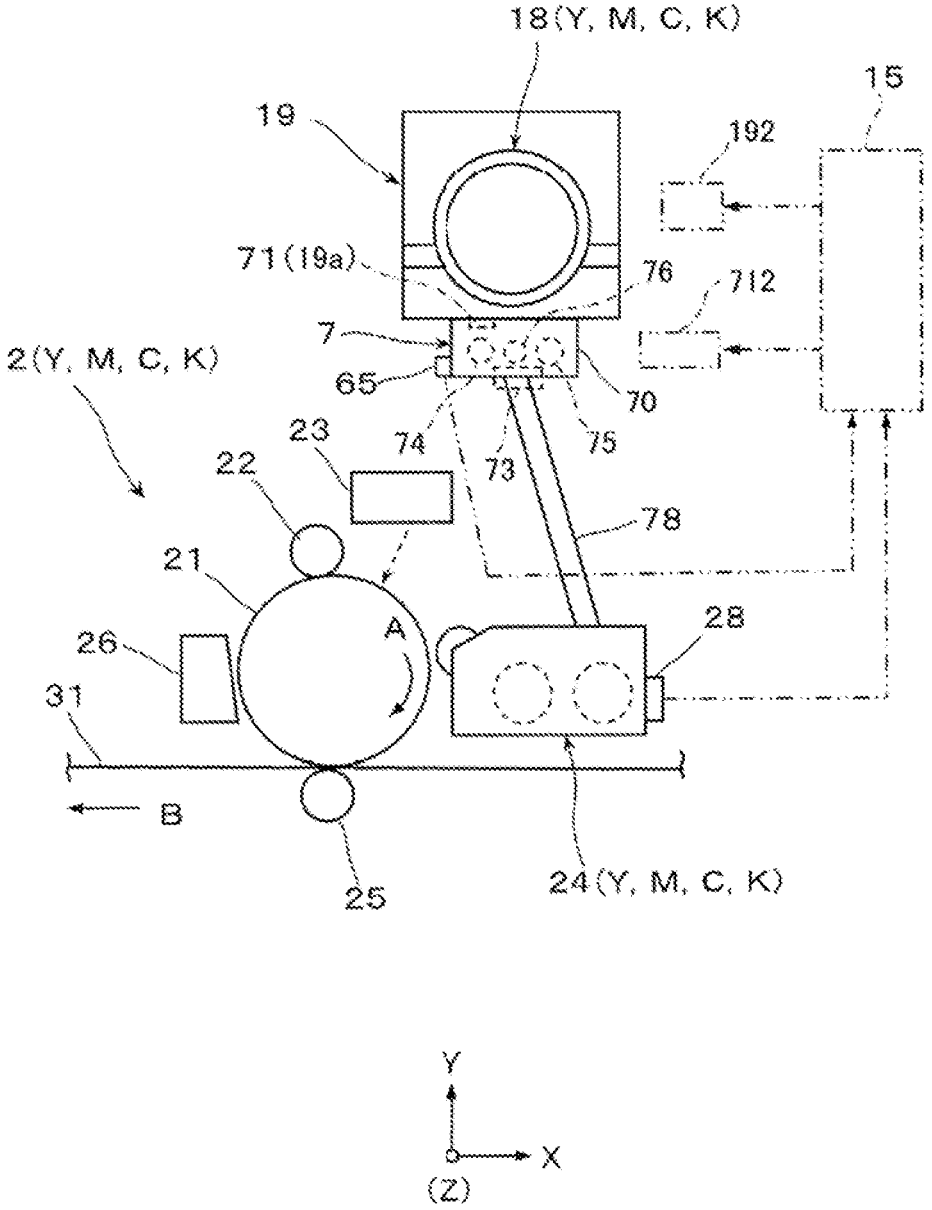
FIG. 2 is a schematic diagram illustrating a partial configuration of the image forming apparatus in FIG. 1.

FIG. 1 and FIG. 2 are sectional views illustrating an image forming apparatus 1 according to the first exemplary embodiment of the present disclosure. FIG. 1 illustrates an overall configuration of the image forming apparatus 1, and FIG. 2 illustrates a partial configuration of the image forming apparatus 1 (mainly an image forming apparatus and a developer supplying device).

The arrows indicated by reference characters X, Y, and Z in each drawing in FIG. 1 and the like indicate width, level, and depth directions of a three-dimensional space assumed in each drawing. Further, in each drawing, a circle at a portion where the arrows in the X and Y directions intersect indicates that the Z direction is directed vertically downward in the drawing.

Configuration of Image Forming Apparatus

The image forming apparatus 1 produces an image with a toner as a developer on a paper 9 as an example of a recording medium. The image forming apparatus 1 according to a first exemplary embodiment includes a printer that forms an image corresponding to image information input from an external connection device such as an information terminal.

As illustrated in FIG. 1, the image forming apparatus 1 includes a housing 10 having a required external shape, and in the internal space of the housing 10, there are provided an image forming device 2 that forms a toner image based on image information, an intermediate transfer device 3 that temporarily holds and transports the toner image formed by the image forming device 2 and then performs secondary transfer onto the paper 9, a paper feeding device 4 that stores and feeds the paper 9 to be supplied to a position where the secondary transfer is performed by the intermediate transfer device 3, and a fixing device 5 that fixes the toner image secondarily transferred by the intermediate transfer device 3 to the paper 9.

Here, the image information is information related to images such as characters, figures, photographs, and patterns. The housing 10 is a structure formed in a required shape using various support members, exterior materials, and the like. A dotted line with an arrow in FIG. 1 or the like indicates a major transporting path when the paper 9 is transported in the housing 10.

The image forming device 2 includes four image forming devices 2Y, 2M, 2C, and 2K that exclusively form four color toner images of yellow (Y), magenta (M), cyan (C), and black (K).

Each of the four image forming devices 2 (Y, M, C, and K) includes a photosensitive drum 21 that is an example of an image holding unit that rotates in a direction indicated by an arrow A, in which around the photosensitive drum 21, a charging device 22, an exposure device 23, a developing machine 24 (Y, M, C, and K), a primary transfer device 25, a drum cleaning device 26, and the like are arranged. In FIG. 1, reference numerals 21 to 26 are all described only in the black (K) image forming device 2K, and some of them are described in other color image forming devices 2 (Y, M, C).

Among these, the charging device 22 is a device that charges an outer circumferential surface (image-formable surface) of the photosensitive drum 21 to a required surface potential. The exposure device 23 is a device that forms an electrostatic latent image of required color components (Y, M, C, and K) on the outer circumferential surface of the photosensitive drum 21 by performing exposure based on the image information. The developing machine 24 (Y, M, C, and K) is a device that develops the electrostatic latent image formed on the outer circumferential surface of the photosensitive drum 21 with a developer (toner) which is a dry powder consisting of corresponding predetermined colors (Y, M, C, and K) to form toner images of predetermined four colors.

In addition, the primary transfer device 25 is a device that electrostatically transfers the toner image of each color formed on the outer circumferential surface of the photosensitive drum 21 to the intermediate transfer device 3 (intermediate transfer belt 31). The drum cleaning device 26 is a device that cleans the outer circumferential surface of the photosensitive drum 21 by removing unnecessary matters such as unnecessary toner and paper dust attached to the outer circumferential surface of the photosensitive drum 21 so as to be scraped off.

In these image forming devices 2 (Y, M, C, and K), each portion where the photosensitive drum 21 (strictly, the intermediate transfer belt 31 of the intermediate transfer device 3) and the primary transfer device 25 face each other becomes a primary transfer position TP1 that performs primary transfer of the toner image.

In the four image forming devices 2Y, 2M, 2C, and 2K, for example, in a case where an image forming operation command that forms a so-called full-color image which is a multi-color image formed by combining the four color (Y, M, C, and K) toner images is received, in the image forming devices 2 (Y, M, C, and K), a charging operation by the charging device 22, an exposure operation by the exposure device 23, a developing operation by the developing machine 24 (Y, M, C, and K), and the like are performed for each photosensitive drum 21 rotating in the direction indicated by the arrow A.

As a result, each of the four color toner images that are separated into four color (Y, M, C, and K) components is formed on each of the photosensitive drums 21 in the image forming devices 2Y, 2M, 2C, and 2K. Subsequently, the four color toner images formed on the respective photosensitive drums 21 are transported to the primary transfer position TP1 by the rotation of the photosensitive drums 21.

The intermediate transfer device 3 is configured to transport the toner images of the respective colors formed by the image forming device 2 (Y, M, C, and K) to a position for secondary transfer onto the paper 9 after being held by the primary transfer. The intermediate transfer device 3 is disposed below the image forming device 2 (Y, M, C, and K) inside the housing 10.

Further, the intermediate transfer device 3 includes the intermediate transfer belt 31 that primarily transfers and holds a toner image from each photosensitive drum 21 in the image forming device 2 (Y, M, C, and K). The intermediate transfer belt 31 is supported by plural support rolls 32*a* to 32*f* arranged on the inner side thereof to sequentially pass through each primary transfer position of the image forming device 2 (Y, M, C, and K) and rotate (circulate) in a direction indicated by an arrow B.

In the plural support rolls, the support roll 32*a* serves as a drive roll that rotates by receiving rotational power from a drive device (not shown), the support roll 32*b* serves as a chamfering roll that holds the belt position (surface) immediately before and after passing through the primary transfer position of the intermediate transfer belt 31 in cooperation with the support roll 32*a*, and the support roll 32*c* serves as a tension roll.

In addition, the support roll 32*d* serves as a chamfering roll before the secondary transfer of the intermediate transfer belt 31, the support roll 32*e* serves as a secondary transfer backup roll, and the support roll 32*f* serves as a chamfering roll after passing through the secondary transfer position of the intermediate transfer belt 31. In a case where the support roll 32*e* serves as a roll to which a secondary transfer voltage is supplied, the secondary transfer voltage is supplied from a power supply device (not shown).

In addition, the primary transfer device 25 in each image forming device 2 (Y, M, C, and K) is disposed inside the intermediate transfer belt 31. The primary transfer device 25 also constitutes a part of the intermediate transfer device 3. The primary transfer device 25 includes a primary transfer roll or the like, and a primary transfer current is supplied to the primary transfer roll from the power supply device (not shown).

In addition, on the outer circumferential surface of the portion supported by the support roll 32*e* of the intermediate transfer belt 31, a secondary transfer device 35 that allows the paper 9 to pass through and secondarily transfers the toner image on the intermediate transfer belt 31 to the paper 9 is disposed. The secondary transfer device 35 includes a secondary transfer roll or the like.

Further, on the outer circumferential surface of the portion of the intermediate transfer belt 31 supported by the support roll 32*a*, a belt cleaning device 36 that cleans the outer circumferential surface of the intermediate transfer belt 31 by removing unnecessary matters such as unnecessary toner remaining on the outer circumferential surface of the intermediate transfer belt 31 after the secondary transfer is disposed.

In the intermediate transfer device 3, the portion where the secondary transfer device 35 is in contact with the outer circumferential surface of the intermediate transfer belt 31 becomes a secondary transfer position TP2 where the secondary transfer of the toner image is performed.

The paper feeding device 4 is configured to store and feed the paper 9 to be supplied to the secondary transfer position TP2 of the intermediate transfer device 3. The paper feeding device 4 is disposed at a position below the image forming device 2 (Y, M, C, and K) inside the housing 10.

In addition, the paper feeding device 4 includes arrangement devices such as a paper storing body 41 and a feeding device 43.

The paper storing body 41 is a storage member that has a loading board 42 which loads and stores plural paper sheets 9 in a required direction, and is attached so that it can be pulled out of the housing 10 and refilled with paper 9 and the like. The feeding device 43 is a device that feeds out the papers 9 loaded on the loading board 42 of the paper storing body 41 one by one by feeding devices such as plural rolls.

The paper 9 may be a recording medium such as a plain paper, a coated paper, or a cardboard that can be transported in the housing 10 and on which a toner image can be transferred and fixed, and the material, form, and the like thereof are not particularly limited.

A paper feeding transporting path Rt1 through which the paper 9 in the paper feeding device 4 is transported and supplied to the secondary transfer position TP2 is provided between the paper feeding device 4 and the secondary transfer position TP2 of the intermediate transfer device 3. This paper feeding transporting path Rt1 includes plural transport rolls 44*a* to 44*c* for nipping and transporting the paper 9, and plural guide members (not shown) for ensuring the transport space for the paper 9 and guiding the transport of the paper 9.

In the intermediate transfer device 3, the four color toner images formed on the respective photosensitive drums 21 in the image forming devices 2 (Y, M, C, and K) are subjected to a primary transfer action of the primary transfer device 25, the toner images are primarily transferred so as to be sequentially superimposed on the outer circumferential surface of the intermediate transfer belt 31 rotating in the direction indicated by the arrow B, and then transported to the secondary transfer position TP2. On the other hand, the required paper 9 is fed from the paper feeding device 4 to the secondary transfer position TP2 in accordance with the timing of forming and transporting the toner image and then transported via the paper feeding transporting path Rt1.

As a result, at the secondary transfer position TP2 in the intermediate transfer device 3, the toner images that are primarily transferred and transported by the intermediate transfer belt 31 are collectively secondarily transferred onto one side of the paper 9 by receiving the transfer action of the secondary transfer device 35.

The fixing device 5 is configured to fix the toner image secondarily transferred by the intermediate transfer device 3 to the paper 9. The fixing device 5 is disposed inside the housing 10 and located at a lower position downstream of the secondary transfer position TP2 of the intermediate transfer device 3 in the transport direction of the paper 9.

The fixing device 5 includes an arrangement of devices such as a heating rotator 51 and a pressurizing rotator 52 in an internal space of a housing 50 provided with an inlet and an exit port for the paper 9.

The heating rotator 51 is a rotator having a roll shape, a belt-pad shape or the like that rotates in a direction indicated by an arrow, and is heated by a heating unit (not shown) so that the outer surface is maintained at a required temperature. The pressurizing rotator 52 is a rotator having a roll shape, a belt-pad shape, or the like that rotates so as to contact and follow the heating rotator 51 under a predetermined pressure. The pressurizing rotator 52 may be heated by the heating unit.

In the fixing device 5, a portion where the heating rotator 51 and the pressurizing rotator 52 come into contact with each other serves as a nip portion (fixing unit) FN that performs processing such as heating and pressurizing for fixing the unfixed toner image on the paper 9.

Between the secondary transfer position TP2 of the intermediate transfer device 3 and the fixing device 5, there is provided a relay transporting path Rt2 that relays and transports secondarily transferred paper 9 so that the paper 9 reaches the fixing device 5. The relay transporting path Rt2 includes an arrangement of, for example, a suction belt transport device 46 and other components.

Further, between the fixing device 5 and an exit port 13, there is provided an output transporting path Rt3 through which the paper 9 is transported after the fixing to the exit port 13 for the paper 9 in the housing 10 so that the paper is output to an output paper storage portion (not shown). The output transporting path Rt3 includes an arrangement of a pair of transport rolls and output rolls (not shown), plural guide members (not shown) for guiding the transport of the paper 9, and the like.

In the fixing device 5, the paper 9 secondarily transferred by the secondary transfer device 35 is introduced into the nip portion FN in the fixing device 5 via the relay transporting path Rt2.

As a result, the paper 9 is subjected to a fixing process by the fixing device 5 to fix the toner image so that a full-color image is formed on one side thereof.

Finally, the paper 9 after the fixing is completed is output to an output paper storage portion (not shown) via the output transporting path Rt3.

In the image forming apparatus 1, a sheet of paper 9 on which a full-color image is formed is output by the above operation. Note that, according to the image forming apparatus 1, it is also possible to form other types of images including a single color image such as a black image.

Configuration of Developer Supplying Device or the Like

In the image forming apparatus 1, as illustrated in FIGS. 1 and 2, the developer of the corresponding color is supplied to each developing machine 24 (Y, M, C, and K) in the image forming device 2 (Y, M, C, and K) from developer containers 18Y, 18M, 18C, and 18K in which the developer is stored for each color in a required amount via a developer supplying device 7.

The developer container 18 (Y, M, C, and K) is a replaceable cartridge type storage container, and is used by being detachably mounted on a mounting device 19. In a case where the developing machine 24 uses a two-component developer, the developer container 18 (Y, M, C, and K) has any one color toner of four colors (Y, M, C, and K) toners as a developer, or a toner containing a small amount of carrier is stored separately for each color.

The developer stored in the developer container 18 (Y, M, C, and K) is supplied from the supplying device 7 individually disposed below the mounting device 19 to the developing machine 24 (Y, M, C, and K). A reference numeral 78 in FIGS. 1 and 2 is a transport pipe installed so as to transport the developer supplied from each supplying device 7 to each developing machine 24 (Y, M, C, and K).

As indicated by a double dotted line in FIG. 2, the mounting device 19 is provided with a drive device 192 that drives a unit to output the developer in the developer container 18. Further, as indicated by a broken line in FIG. 2, the mounting device 19 is provided with an exit port 19*a* that outputs the developer supplied from the developer container 18 and sends it to the supplying device 7 (a receiving port 71 described later).

Figure 3:
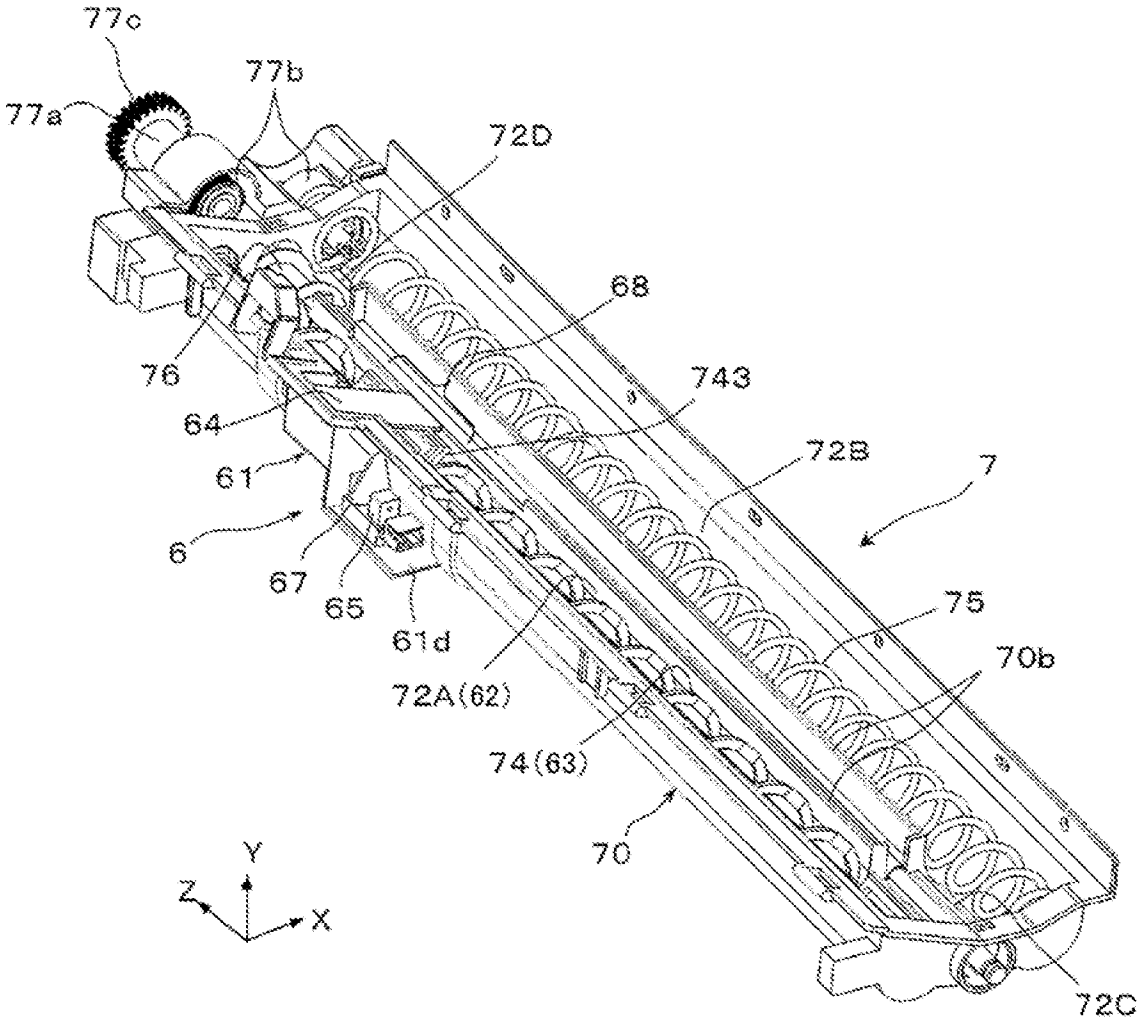
FIG. 3 is a perspective view illustrating a developer supplying device (with an upper surface plate removed) and a storage level detecting device.
Figure 4:
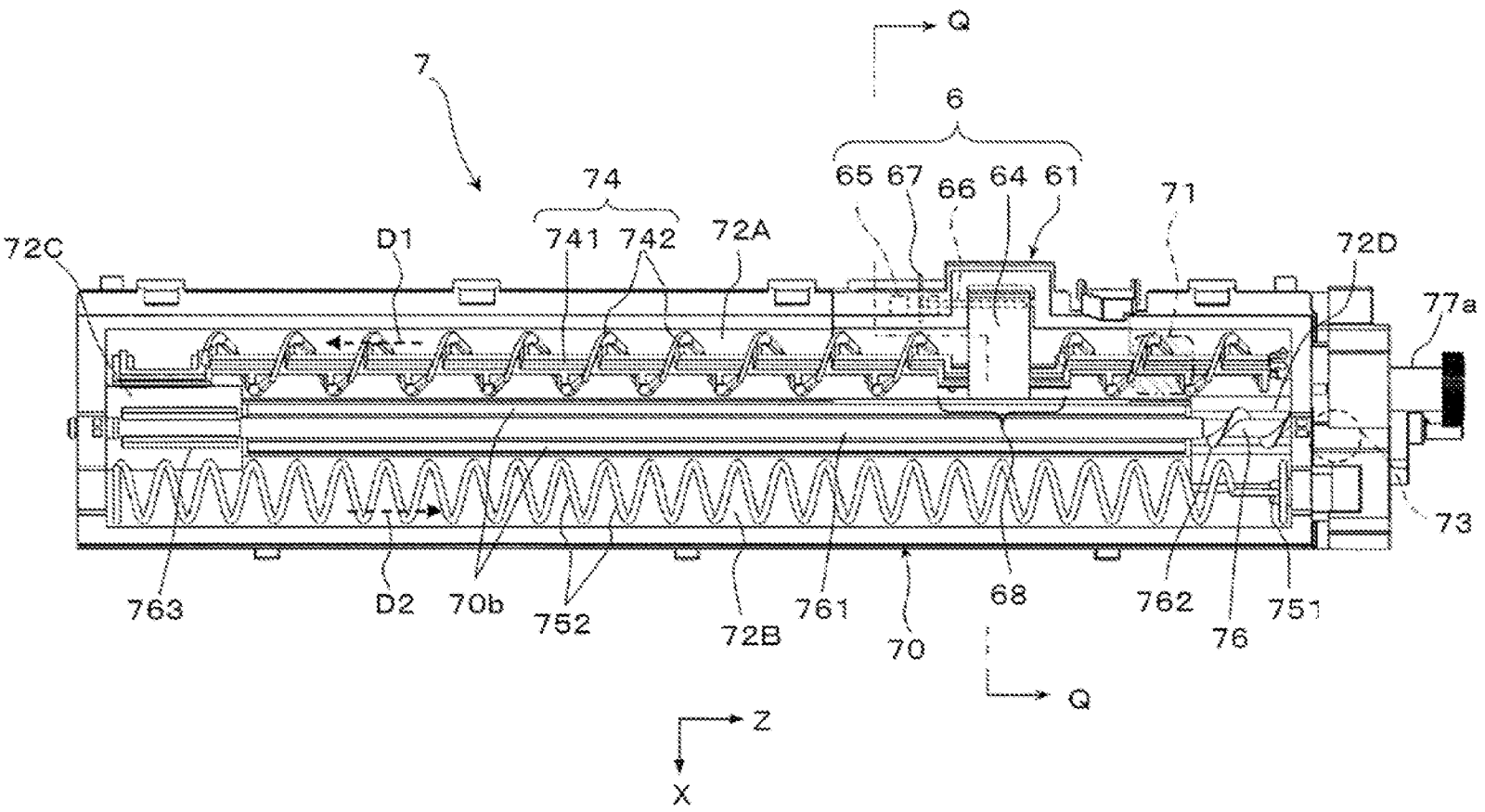
FIG. 4 is a plan view illustrating the supplying device and the storage level detecting device of FIG. 3.

As illustrated in FIGS. 2 to 4, the supplying device 7 includes the receiving port 71 that receives the developer supplied from the developer container 18 (Y, M, C, and K) and transporting paths 72A (62) and 72B for transporting the developer, a main body 70 having a feeding port 73 that feeds the developer in the transporting paths 72A and 72B to a supply destination such as the developing machine 24, developer transporting units 74 (63) and 75 individually arranged to rotate in the transporting paths 72A and 72B, a feeding unit 76 that feeds the developer in the transporting paths 72A and 72B to the feeding port 73, and a developer storage level detecting device 6 that detects the surface level of the developer being transported in the transporting path 72A.

The main body 70 is a container-shaped structure that is long in one direction (for example, the depth direction and the longitudinal direction indicated by the arrow Z), and is provided with two rows of transporting paths 72A and 72B that extend in parallel along the longitudinal direction are formed in the lower part thereof. FIGS. 3 and 4 illustrate a state in which an upper surface plate (lid body) (not shown) of the main body 70 is removed from the supplying device 7.

The transporting path 72A is a first transporting path, the transporting path 72B is a second transporting path.

Figure 5A:
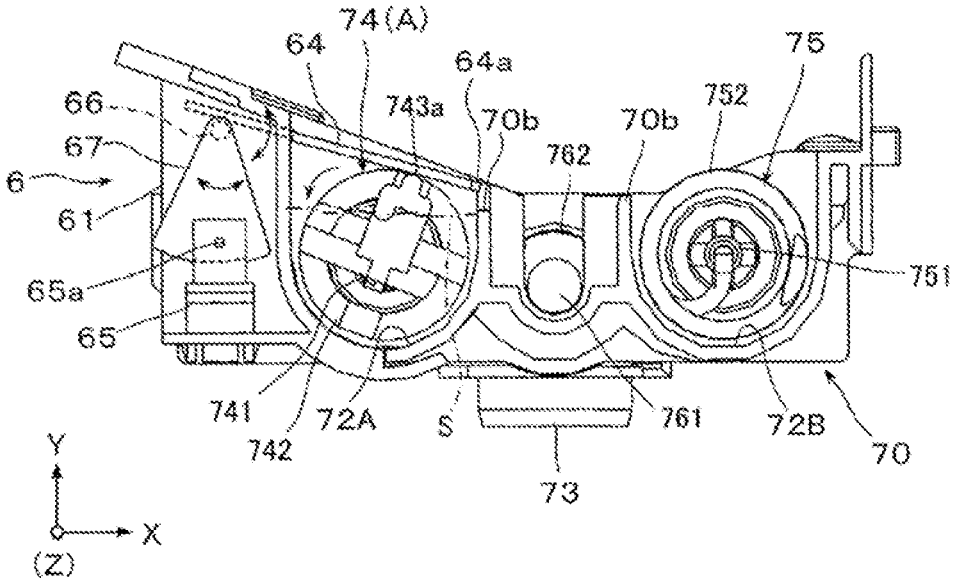
FIGS. 5A and 5B are schematic sectional views taken along line Q-Q of the supplying device and the storage level detecting device of FIG. 4.
Figure 5B:
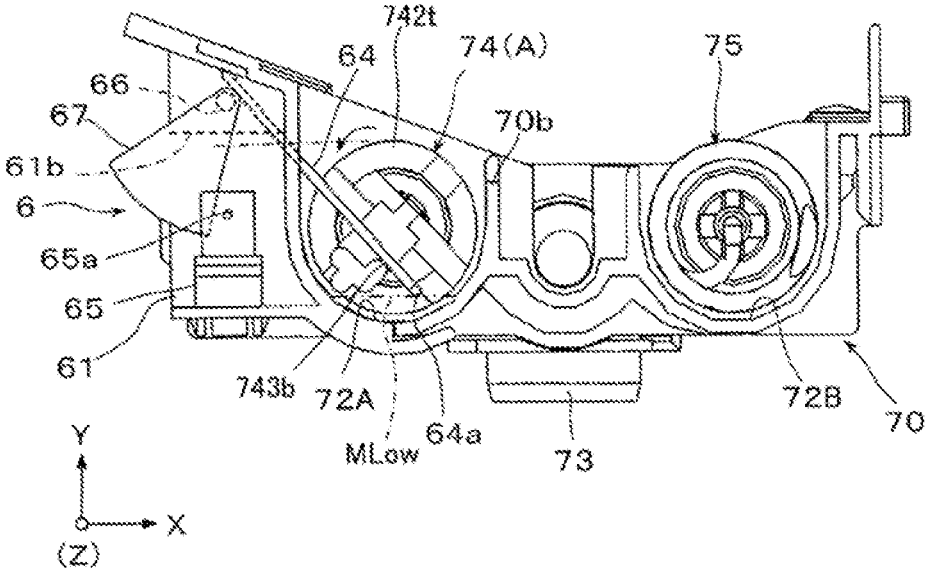

Each of the first transporting path 72A and the second transporting path 72B is formed as a groove having a U-shaped cross-sectional shape and extending linearly as illustrated in FIG. 4 and FIGS. 5A and 5B.

In addition, while the first transporting path 72A and the second transporting path 72B are partitioned by a plate-shaped partition wall 70*b* along the longitudinal direction between the both, at both ends in the longitudinal direction, they are connected to each other via a first communication passage 72C and a second communication passage 72D where the partition wall 70*b* is not present.

As illustrated in FIGS. 2 and 4, the receiving port 71 is provided to be present at an upper position in front of the end portion on the upstream side of the developer transport direction (D1) in the first transporting path 72A in the main body 70. The receiving port 71 is formed on an upper surface plate (not shown) of the main body 70. In addition, the receiving port 71 is connected to the exit port 19*a* of the developer in the mounting device 19 of the developer container 18 so as to face each other (FIG. 2).

As illustrated in FIGS. 2 and 4, the feeding port 73 is provided at a portion (one end portion in the longitudinal direction of the main body 70) that is outside from the second communication passage 72D.

The developer transporting unit 74 is a first transporting unit disposed in the first transporting path 72A. The developer transporting unit 75 is a second transporting unit disposed in the second transporting path 72B.

As illustrated in FIGS. 3 to 5B, and the like, the first transporting unit 74 includes a transporting member having a structure with a transporting section 742 that is provided in a spiral shape with a predetermined pitch with a gap around a rotating shaft 741, and is rotatably disposed in the first transporting path 72A. The second transporting unit 75 includes a transporting member having a structure with a transporting section 752 provided so as to spirally extend at a predetermined pitch from a rotating shaft portion 751 at one end to the other end without a shaft, and is rotatably disposed in the second transporting path 72B.

Further, the first developer transporting unit 74 and the second developer transporting unit 75 rotate in a predetermined direction by the rotational power transmitted from a drive input shaft 77*a* via a gear train mechanism 77*b*.

With this, in the first transporting path 72A, the developer is transported in the direction indicated by the arrow D1 by the rotation of the first transporting unit 74. In addition, in the second transporting path 72B, the developer is transported in the direction indicated by an arrow D2 by the rotation of the second transporting unit 75. The rotational power output from a drive device 712 (FIG. 2) for supplying the developer is transmitted to the drive input shaft 77*a* via an input gear 77*c*.

The feeding unit 76 is disposed so as to be present in the second communication passage 72D. The feeding unit 76 includes a rotating shaft 761 rotatably disposed on the main body 70 so as to pass through the first communication passage 72C and the second communication passage 72D between partition walls 70*b*, a spiral transporting section 762 provided continuously and spirally protruding from a portion of the rotating shaft 761 extending from the second communication passage 72D to the feeding port 73; a plate-shaped feeding blade portion 763 provided along the axial direction in a portion of the rotating shaft 761 that is present in the first communication passage 72C.

Similarly to the case of the first transporting unit 74 and the second transporting unit 75, the feeding unit 76 rotates in a predetermined direction by the rotational power transmitted to the rotating shaft 761 from the drive input shaft 77*a* via the gear train mechanism 77*b*.

As a result, in the feeding unit 76, the developer in the second communication passage 72D is fed out toward the feeding port 73 by the spiral transporting section 762, and the developer in the first communication passage 72C is fed out toward the second transporting path 72B by the feeding blade portion 763.

The feeding unit 76 is rotated and driven simultaneously when the first transporting unit 74 and the second transporting unit 75 are rotated and driven.

Configuration of developer storage level detecting device Next, a developer storage level detecting device 6 will be described.

First, as illustrated in FIG. 3, FIG. 4, and so on, the storage level detecting device 6 includes: a main body 61, which is a part of the main body 70 having the first transporting path 72A in the supplying device 7 as an example for which the storage level detecting device 6 is to be used; the first transporting unit 74 that is disposed in the first transporting path 72A to rotate in the first transporting path 72A; a swingable member 64 that comes into contact with the surface of the developer being transported in the first transporting path 72A and swings while following at least the surface level of the stored developer; and a detecting unit 65 that detects the swing state of the swingable member 64.

The main body 61 is a portion of the main body 70 in the supplying device 7 where at least the first transporting path 72A is provided. The main body 61 according to the first exemplary embodiment has a structure provided with a protruding portion having a recessed space that protrudes outward from a part of the first transporting path 72A of the main body 70 in a direction substantially orthogonal to the developer transport direction D1. The recessed space in the protruding portion is connected to the upper space in the first transporting path 72A, but has an inclined surface located higher than the first transporting unit 74 as a bottom surface portion 61*b* of the space goes away from the first transporting path 72A (FIG. 5B), and thus the developer does not enter the first transporting path 72A. Further, the recessed space is used as a space for disposing a part of the swingable member 64.

As described above, the first transporting unit 74 is disposed so as to rotate in the first transporting path 72A, and includes the transporting member having a structure with the transporting section 742 provided in a spiral shape around the rotating shaft 741 with a space therebetween.

The swingable member 64 includes, for example, a plate-shaped member that is long in one direction. As illustrated in FIGS. 3 to 5B, in the swingable member 64, one end in the longitudinal direction thereof is fixedly attached to a swing support shaft 66 disposed so as to swing in the recessed space of the protruding portion of the main body 61, and the other end in the longitudinal direction thereof comes into contact with the surface (S) of the developer in a stored state that passes over the first transporting unit 74 and is transported in the first transporting path 72A. Further, the swingable member 64 is disposed so that the longitudinal direction thereof is in a state along a direction substantially orthogonal to the rotating shaft 741 of the first transporting unit 74.

The swing support shaft 66 for supporting the swingable member 64 is provided so as to be rotatable in a state of being along a direction substantially orthogonal to the rotating shaft 741 of the first transporting unit 74 and in a state of crossing the recessed space of the protruding portion of the main body 61. Further, one end of the swing support shaft 66 is provided so as to protrude outward from the side surface of the protruding portion of the main body 61. As illustrated in FIGS. 3 to 5B, and the like, a detection target plate 67, which is an example of a detecting target that is actually detected by the detecting unit 65, is fixedly attached to the end of the protruding portion of the swing support shaft 66. The detection target plate 67 is made of, for example, a fan-shaped member. The detection target plate 67 swings in conjunction with the swingable member 64 when the swing of the swingable member 64 is transmitted via the swing support shaft 66.

Figure 7:
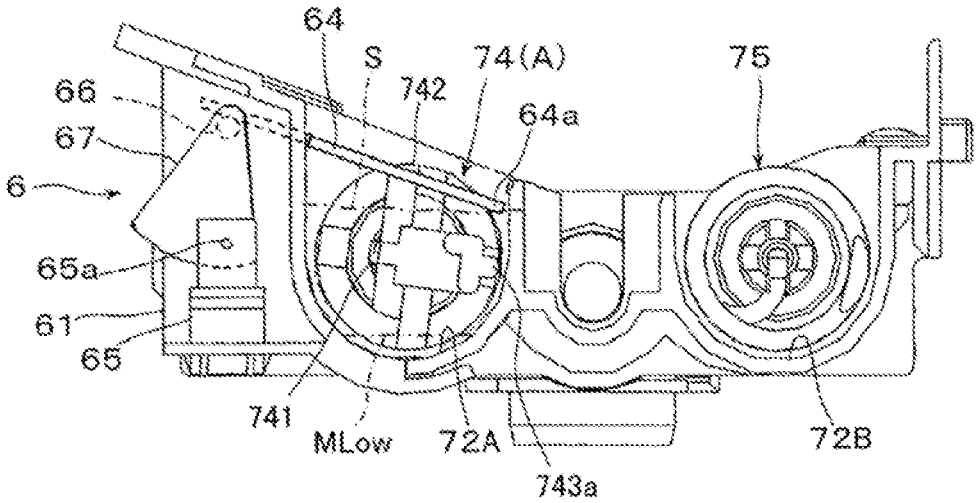
FIG. 7 is a schematic sectional view illustrating another state of the supplying device and the storage level detecting device of FIGS. 5A and 5B.

As illustrated in FIG. 5A, the swingable member 64 is fixed to the swing support shaft 66 so as to swing in the direction indicated by the double arrow around the swing support shaft 66 as a fulcrum. As illustrated in FIG. 5B and FIG. 7, therefore, the swingable member 64 allows the swing tip end portion, which is the other end, to come into contact with the surface (S) of the developer in the first transporting path 72A and swings while following at least the surface level (S) of the stored developer.

In this case, the storage level is the distance between the surface (S) of the developer in the first transporting path 72A and the bottom surface of the first transporting path 72A, which is substantially determined depending on the amount (volume) stored and accumulated in the first transporting path 72A.

The detecting unit 65 detects the swing state of the swingable member 64. In the first exemplary embodiment, the detecting unit 65 detects the state of the detection target plate 67 swinging in conjunction with the swingable member 64.

The detecting unit 65 includes, for example, a transmissive or reflective photosensor. The detecting unit 65 including a photosensor includes a detecting part 65*a* that detects whether or not the detection light emitted from a light emitting unit is received by a light receiving unit. As the detecting unit 65 including the photosensor in the first exemplary embodiment, a type having a single detecting part 65*a* is applied.

On the other hand, the detection target plate 67 is a member having light shielding properties in a case where the detecting unit 65 is a transmissive photosensor. Further, as illustrated in FIG. 5B, the detection target plate 67 allows the detecting unit 65 to detect the state generated when the swingable member 64 swings in response to the fact that the surface level (S) of the developer stored in the first transporting path 72A is lowered (the fact that the surface level approaches the minimum detectable level MLow).

As illustrated in FIG. 3, the detecting unit 65 is mounted on an outer portion 61*d* located outside the first transporting path 72A in the main body 61 (main body 70 of the supplying device 7).

The outer portion 61*d*, on which the detecting unit 65 is mounted in the first exemplary embodiment, is formed adjacent to one side of the main body 61 having the recessed space in which the base end of the swingable member 64 is disposed in the main body 61. Thus, the outer portion 61*d* where the detecting unit 65 is mounted is isolated from the first transporting path 72A.

Moreover, in this storage level detecting device 6, as illustrated in FIGS. 3 and 4, the first transporting unit 74(A) which has a non-transporting section 68 which does not have the transporting section 742 is applied as the first transporting unit 74, and the swingable member 64 is disposed to swing in a state of being present in the non-transporting section 68 in the first transporting unit 74(A).

Figure 6:
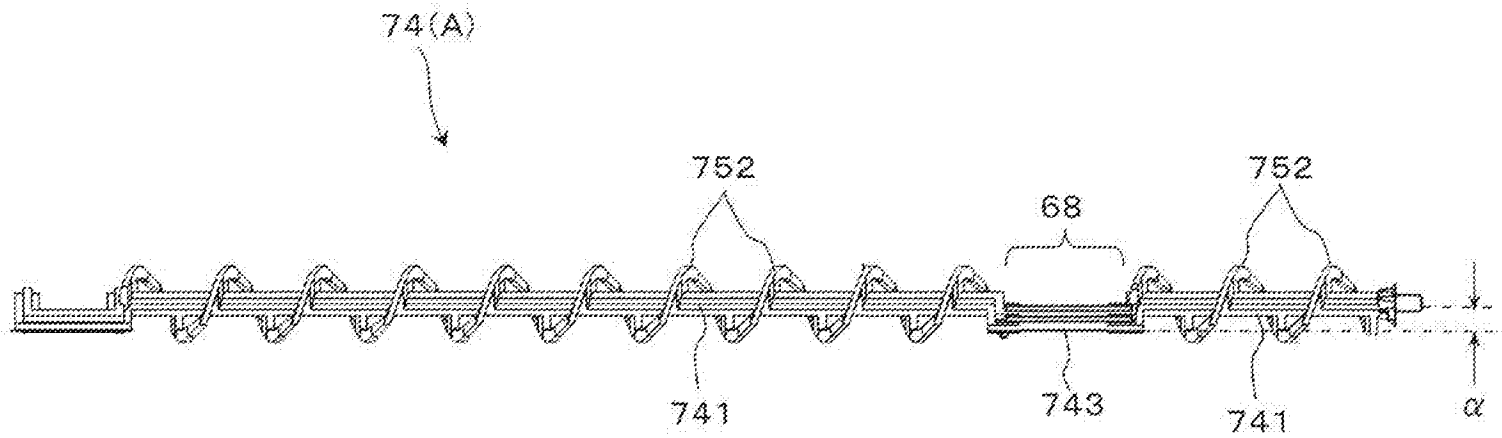
FIG. 6 is a plan view illustrating a developer transporting unit in a storage level detection position of FIG. 3.

As illustrated in FIGS. 4 and 6, the first transporting unit 74(A) has a structure in which the spiral transporting section 742 is interrupted at a region where the swingable member 64 of the storage level detecting device 6 is provided. The first transporting unit 74(A) has the non-transporting section 68, which is formed at the portion where the transporting section 742 is interrupted and absent (the portion where only the rotating shaft 741 is present or the portion where an eccentric shaft 743 described later is provided as in this example).

In this case, as illustrated in FIGS. 4 and 5A, the swingable member 64 is in a state of being present above at least the rotating shaft 741 (actually eccentric shaft 743 to be described later) in the non-transporting section 68, and a swing tip end portion 64*a*, which is also a free end opposite to the base end supported by the swing support shaft 66, is disposed in a state of being present in the first transporting path 72A by passing over the eccentric shaft 743 to be described later of the non-transporting section 68.

In this case, in the first transporting path 72A, the developer cannot directly obtain the transport force by the transporting section 742 of the first transporting unit 74(A) in the portion where the non-transporting section 68 is present, and thus is in a state of being temporarily retained. However, since the retained developer is pushed by the developer transported from the upstream side in the developer transport direction D1, the developer is sequentially fed so as to pass through the portion where the non-transporting section 68 is present.

Further, as illustrated in FIG. 6 and the like, in the non-transporting section 68 of the first transporting unit 74(A), the eccentric shaft 743 that is deviated from the axial center of the rotating shaft 741 in a portion other than the non-transporting section 68 is applied as a rotating shaft.

As illustrated in FIG. 5B, the eccentric shaft 743 has an eccentric shape by a predetermined eccentric amount $\alpha$ such that the swing tip end portion 64*a* thereof reaches the minimum detectable level (MLow) of the surface (S) of the developer in a state where the plate-shaped swingable member 64 comes in contact with the eccentric shaft 743.

As illustrated in FIG. 6 and the like, the eccentric shaft 743 in the first exemplary embodiment has a shape (crank shape) having a linear shaft portion parallel to the axial direction of the rotating shaft 741 within the range of the non-transporting section 68 after rising in the vertical direction from the rotating shaft 741 adjacent to both ends of the non-transporting section 68 in the vertical direction by the level of the eccentric amount $\alpha$.

In this storage level detecting device 6, since the eccentric shaft 743 is applied as the rotating shaft in the non-transporting section 68, in a case where the developer is not present in the first transporting path 72A or a case where the developer becomes less, as illustrated in FIGS. 5A and 5B, the swingable member 64 may be in a state of swing when the lower surface portion thereof is periodically in contact with an outermost circumferential portion 743*a* or an innermost circumferential portion 743*b* of the eccentric shaft 743 to be described later of the non-transporting section 68 in the rotating first transporting unit 74(A).

As a result, the swingable member 64 in the storage level detecting device 6 swings while following the surface level (S) of the stored developer as described above, and in addition, may periodically swings in a vertical direction by being in contact with the rotating eccentric shaft 743.

The outermost circumferential portion 743*a* is a portion located on the outermost side with respect to the axial center of the rotating shaft 741 of the eccentric shaft 743. In addition, the innermost circumferential portion 743*b* is a portion located on the innermost side with respect to the axial center of the rotating shaft 741 of the eccentric shaft 743.

Further, in the storage level detecting device 6, as illustrated in FIG. 5B, the swing support shaft 66 serving as a swing fulcrum is disposed above an upper end 742*t* of the transporting section 742, which is the uppermost portion of the first transporting unit 74(A).

The position of the swing support shaft 66 serving as a fulcrum is preferably as high as possible above the uppermost portion of the first transporting unit 74(A), and in a case where the dimension of the storage level detecting device 6 and the supplying device 7 is restricted in the level direction, it may be at a position close to the dimension restriction.

Further, as illustrated in FIG. 4 and so on, the storage level detecting device 6 is disposed at a position downstream of the receiving port 71 in the transport direction D1 of the developer and closer to the receiving port 71 in the first transporting path 72A.

More specifically, the swingable member 64 of the storage level detecting device 6 is disposed at a position deviating from the position directly below the receiving port 71 in the first transporting path 72A (position downstream of the receiving port 71 in the transport direction D1 of the developer).

Operation of Developer Supplying Device

Next, the operation of the developer supplying device 7 having the above configuration will be described. The supplying device 7 is controlled and operated by a control unit 15 as illustrated in FIG. 2.

That is, in this image forming apparatus 1, as illustrated in FIG. 2, the amount (for example, the amount of toner in the case of a two-component developer: concentration) of the developer stored in each developing machine 24 (Y, M, C, and K) is detected by a detecting unit 28, and the detection information is sent to the control unit 15 and managed. If the control unit 15 determines that the toner in any of the developing machines 24 (Y, M, C, and K) is insufficient, the drive device 712 for supply that rotates the feeding unit 76 of the supplying device 7 connected to the developing machine 24 of the color determined to be insufficient in the toner is controlled so as to be driven for a required time. As a result, the supplying device 7 operates.

At this time, in the supplying device 7, the rotational power of the drive device 712 for supply is also transmitted to the first transporting unit 74(A) and the second transporting unit 75 so that the first transporting unit 74(A) and the second transporting unit 75 are driven to rotate in a predetermined direction.

As a result, the developers contained in the first transporting path 72A and the second transporting path 72B are respectively transported in the predetermined transport directions D1 and D2 by the transport force of the first transporting unit 74(A) and the transport force of the second transporting unit 75 (FIG. 4).

That is, the developer in the supplying device 7 is transported so as to go back and forth between the first transporting path 72A and the second transporting path 72B via the first communication passage 72C and the second communication passage 72D, and is transported so as to circulate as a whole. In addition, a part of the developer at this time is transported toward the feeding port 73 by receiving the transport force by the spiral transporting section 762 of the feeding unit 76 when being moved through the second communication passage 72D.

In this manner, in the supplying device 7, the developer stored in the first transporting path 72A, the second transporting path 72B, and the like in the main body 70 is fed out from the feeding port 73 via the second communication passage 72D, and the fed developer is relayed and fed to the developing machine 24 of the color determined to be insufficient of toner through the transport pipe 78, so that the developer is supplied.

Further, as illustrated in FIG. 2, the supplying device 7 detects the surface level (S) of the stored developer in the first transporting path 72A in the main body 70 by the developer storage level detecting device 6, and the detection result is sent to the control unit 15 for management.

When the control unit 15 determines that the developer storage level in the first transporting path 72A is low and the developer stored in the main body 70 is insufficient, the drive device 192 of the mounting device 19 connected to the supplying device 7 determined to be insufficient in the developer is controlled to drive for a required time.

As a result, the unit that outputs the developer in the developer container 18 in the mounting device 19 is activated such that the developer in the developer container 18 is supplied and charged into the supplying device 7 via the mounting device 19. At this time, the developer in the developer container 18 is output from the exit port 19*a* in the mounting device 19, and then dropped and supplied to the first transporting path 72A through the receiving port 71 of the supplying device 7.

Operation of Developer Storage Level Detecting Device

Next, the operation of the storage level detecting device 6 will be described. The storage level detecting device 6 detects the level of the developer stored in the first transporting path 72A in the main body 70 when the supplying device 7 operates.

In the storage level detecting device 6, the swingable member 64 swings while following at least the surface level (S) of the developer stored in a portion of the first transporting path 72A where the non-transporting section 68 is present in the first transporting unit 74(A) (hereinafter, also simply referred to as "detection region"), and the detecting unit 65 detects the swing state of the swingable member 64.

Note that, in this storage level detecting device 6, since the eccentric shaft 743 of the non-transporting section 68 in the first transporting unit 74(A) rotates around the rotating shaft 741 in the detection region, the eccentric shaft 743 moves so as to pass below the swingable member 64.

Here, in a case of assuming a stage where a sufficient amount of the developer is stored in the detection region in the first transporting path 72A, at that stage, the swingable member 64 operates as follows to detect the level of the stored developer.

That is, at the stage where there is a sufficient amount of developer, as illustrated in FIG. 5A, the swingable member 64 comes in contact with the outermost circumferential portion 743*a* of the eccentric shaft 743 of the non-transporting section 68 in the first transporting unit 74(A) rotating in the detection region to swing in the direction in which the swing tip end portion 64*a* is raised (lifted), and as illustrated in FIG. 7, regardless of the position of the eccentric shaft 743 of the non-transporting section 68 in the rotating first transporting unit 74(A), the swingable member 64 swings at a position where the swing tip end portion 64*a* is in contact with the surface (S) of the developer without coming into contact with the eccentric shaft 743.

Figure 8:
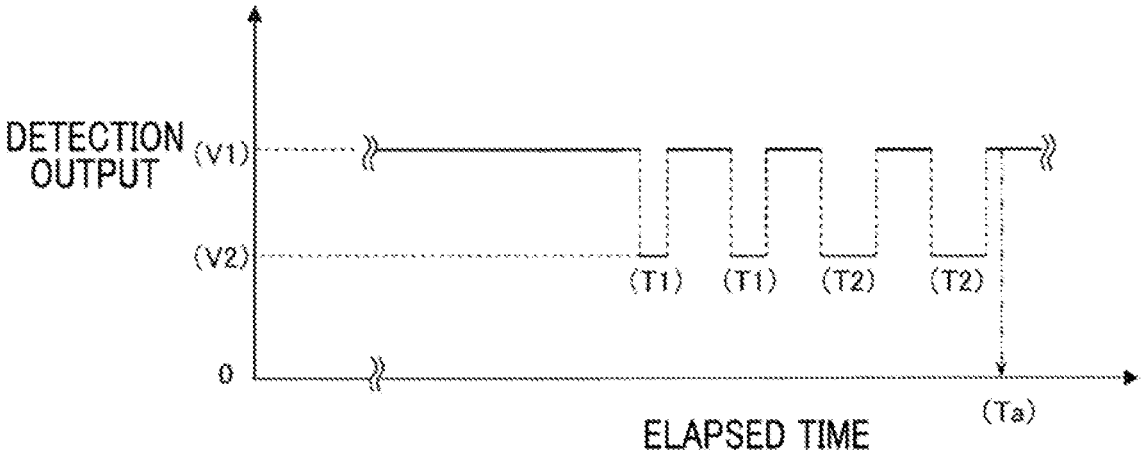
FIG. 8 is a conceptual diagram illustrating an example of a detection output of a detecting unit in the first exemplary embodiment.

At this time, as illustrated in FIG. 5A and FIG. 7, in any of the above-described swing states, the detection target plate 67 that swings in conjunction with the swingable member 64 swings to a position where the detection light in the detecting part 65*a* of the detecting unit 65 is blocked. Further, the detection output of the detecting unit 65 at this time is obtained as a predetermined first output value (V1) determined in advance as illustrated in FIG. 8.

The storage level detecting device 6 (or control unit 15) is set so that the detection output of the detecting unit 65 at this time is set to be handled as detection information that "developer is present".

On the other hand, in a case of assuming a stage where the developer stored in the detection region of the first transporting path 72A gradually decreases due to the supply operation, at that stage, the swingable member 64 becomes in the following state to detect the level of the stored developer.

That is, at the stage where the developer decreases, the surface (S) of the stored developer starts to become relatively low, so that the swingable member 64 in which the swing tip end portion 64*a* is in contact the surface (S) of the developer and gradually starts to swing in the direction of lowering the swing tip end portion 64*a*.

At this time, if the developer decreases to a level at which the level of the stored developer approaches the minimum detectable level MLow, as illustrated in FIG. 5B, the detection target plate 67 that swings in conjunction with the swingable member 64 may swing to a position that does not block the detection light in the detecting part 65*a* of the detecting unit 65. Further, the detection output of the detecting unit 65 at this time is obtained as a predetermined second output value (V2) determined in advance as illustrated in FIG. 8.

The second output value (V2) is different from the first output value (V1). Further, the second output value (V2) is obtained as an output value for a relatively short time T1 at the time before the swingable member 64 is allowed to swing in contact with the innermost circumferential portion 743*b* of the eccentric shaft 743 of the non-transporting section 68 as illustrated in FIG. 5B, but in the stage where the swingable member 64 is allowed to swing in contact with the innermost circumferential portion 743*b* of the eccentric shaft 743 of the non-transporting section 68, the second output value (V2) is obtained as an output value of substantially constant and relatively long time T2 (>T1) (FIG. 8).

At this time, the swingable member 64 comes into contact with the outermost circumferential portion 743*a* of the eccentric shaft 743 of the non-transporting section 68 in the first transporting unit 74(A) rotating in the detection region, and the swing tip end portion 64*a* is also in the state of swing in the ascending direction. The state of swing in this way continues while the first transporting unit 74(A) is rotating.

The detection target plate 67 at this time is in a state of swing to a position where the detection light in the detecting part 65*a* of the detecting unit 65 is blocked as illustrated in FIG. 5A. Further, the detection output of the detecting unit 65 at this time is obtained being determined as the first output value (V1) again as illustrated in FIG. 8.

In addition, in the storage level detecting device 6 (or control unit 15), for example, when the second output value (V2) at the time T2 among the detection outputs of the detecting unit 65 at this time reaches a time point (Ta) obtained exceeding a predetermined number of times as illustrated in FIG. 8, it is set to be handled as detection information that "developer is insufficient or absent".

Therefore, according to the storage level detecting device 6, the level of the developer stored in the first transporting path 72A in the main body 70 of the developer supplying device 7 is detected without providing a space for storing and detecting a developer different from the first transporting path 72A, and without extending the first transporting path 72A for the installation of the swingable member 64.

In addition, according to this storage level detecting device 6, since the eccentric shaft 743 is applied to the non-transporting section 68 in the first transporting unit 74(A), as compared to the case where the eccentric shaft 743 is not applied, it becomes easy to increase the width (swing width) of the swingable member 64 in the swing direction in the first transporting path 72A. In addition, by appropriately setting the eccentric amount $\alpha$ of the eccentric shaft 743, it becomes easy to reliably detect the storage level (particularly, a state close to the minimum detectable level MLow) particularly when the amount of developer is reduced.

Moreover, according to the storage level detecting device 6, since the swing support shaft 66 serving as a fulcrum at the time of swing of the swingable member 64 is disposed at a position above the uppermost portion 742*t* of the first transporting unit 74(A), as compared to the case where the position is not set at such a position, the swing tip end portion 64*a* of the swingable member 64 can easily detect the level of the developer stored in the first transporting path 72A. In addition, since the detecting unit 65 is disposed in a portion 61*d* that is outside the first transporting path 72A, as compared to the case where the outside portion 61*d* is not disposed, stable detection is possible without the possibility that the detecting unit 65 is contaminated with the developer.

Furthermore, when the storage level detecting device 6 is used, in particular, the swingable member 64 is disposed at a position downstream of the receiving port 71 in the transport direction D1 of the developer and closer to the receiving port 71 (FIG. 4) in the first transporting path 72A in the supplying device 7, so that the level of the developer in a reduced amount is efficiently detected at an early stage, as compared to the case where it is not disposed in such a position (for example, the position of the end portion downstream in the transport direction D1 of the developer in the first transporting path 72A or any position in the second transporting path 72B), because the swingable member 64 is close to the receiving port 71 at which the amount of the developer supplied from the developer container 18 is reflected. In addition, the swingable member 64 is disposed at a position deviating from the position directly below the receiving port 71, so that the developer received from the receiving port 71 in the supplying device 7 is prevented from lying on the swingable member 64, which would otherwise make the swing of the swingable member 64 unstable, and that the detection accuracy is prevented from decreasing.

Second Exemplary Embodiment

Figure 9A:
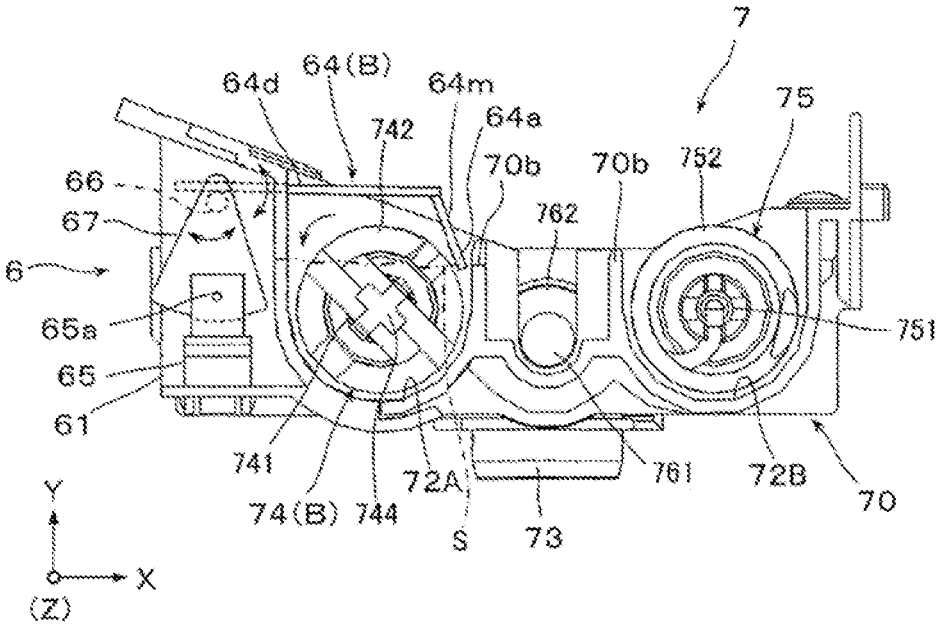
FIGS. 9A and 9B are schematic sectional views illustrating a supplying device and a storage level detecting device according to a second exemplary embodiment.
Figure 9B:
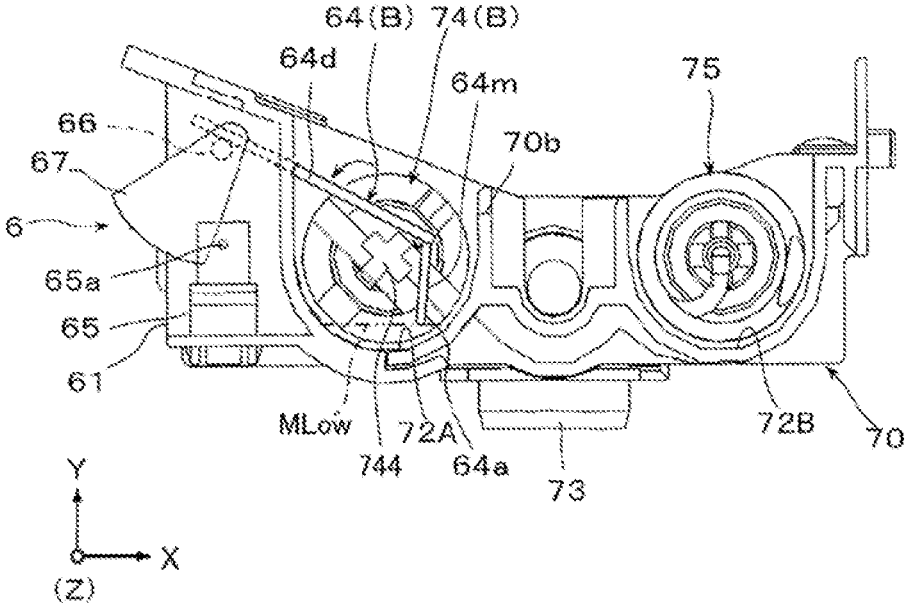

FIGS. 9A and 9B are drawings illustrating the developer supplying device 7 provided with the developer storage level detecting device 6 according to the second exemplary embodiment of the present disclosure.

The developer storage level detecting device 6 and the supplying device 7 according to the second exemplary embodiment have the same configuration as that of the developer storage level detecting device 6 and the supplying device 7 according to the first exemplary embodiment except that the first transporting unit 74(A) relating to the storage level detecting device 6 is changed to a first transporting unit 74(B) having a partially different configuration, and the swingable member 64 is changed to a swingable member 64(B) having a partially different form.

Figure 10:
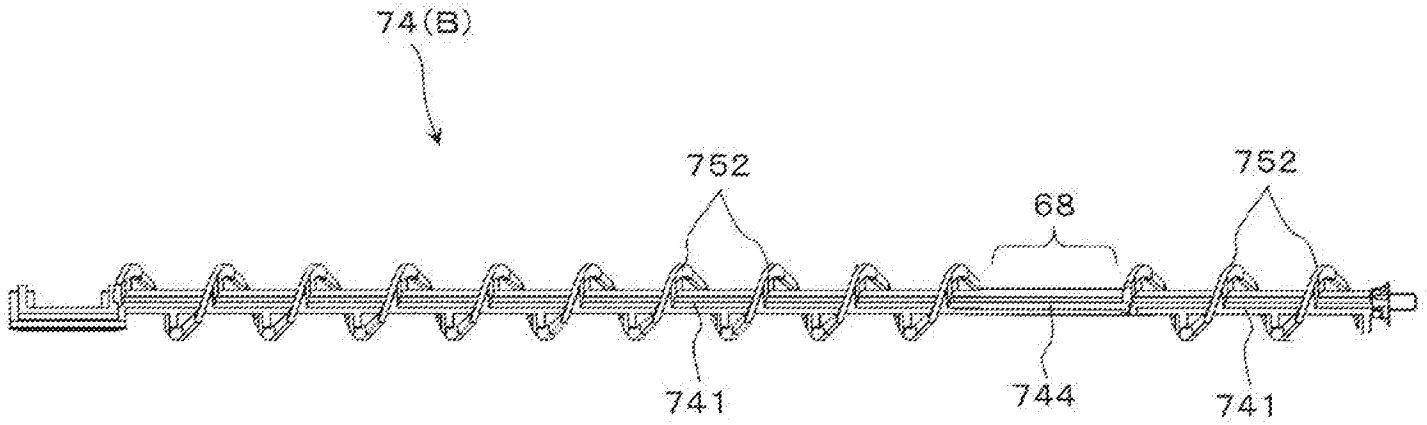
FIG. 10 is a plan view illustrating a developer transporting unit in a storage level detection position of FIGS. 9A and 9B.

In the first transporting unit 74(B) in the storage level detecting device 6 according to second exemplary embodiment, as illustrated in FIGS. 9A and 9B and FIG. 10, instead of the eccentric shaft 743, a coaxial structure 744 that is not deviated from the axial center of the rotating shaft 741 in the portion other than the non-transporting section 68 is used as the rotating shaft of the non-transporting section 68.

The coaxial structure 744 may have the same shape as the rotating shaft 741, or may have a slightly different shape (for example, a cylindrical shape or a tubular shape having a circular cross section) as long as the axial center is coincident with that of the rotating shaft 741.

Further, the swingable member 64(B) in the storage level detecting device 6 is bent so as to reach a position of the minimum detectable level MLow of the surface (S) of the developer beyond the coaxial structure 744 in the non-transporting section 68 as illustrated in FIGS. 9A and 9B.

In the swingable member 64(B) in the second exemplary embodiment, a first portion 64*d* from the swing support shaft 66 to the coaxial structure 744 is formed in a flat plate shape, for example, and has a flat plate shape that is bent at a required angle so as to bend a second portion 64*m* beyond the coaxial structure 744 to the swing tip end portion 64*a* with respect to the first portion 64*d*. That is, in a case of comparing the swingable member 64(B) with the swingable member 64 in the first exemplary embodiment, both are different from each other in that, as a whole, the portion on the tip end side including the swing tip end portion 64*a* is bent downward beyond the coaxial structure 744.

In addition, in the storage level detecting device 6, the bent swingable member 64(B) swings while following at least the surface level (S) of the developer stored in a portion of the first transporting path 72A where the non-transporting section 68 is present in the first transporting unit 74(B) (hereinafter, also simply referred to as "detection region"), and the detecting unit 65 detects the swing state of the swingable member 64(B).

Note that, in this storage level detecting device 6, since the coaxial structure 744 is applied as the rotating shaft in the non-transporting section 68, in a case where the developer is not present in the first transporting path 72A or a case where the developer becomes less, as illustrated in FIG. 9B, the swingable member 64(B) may be in a state of swinging when the lower surface portion of the first portion 64*d* is in contact with an outermost circumferential portion of the coaxial structure 744 of the non-transporting section 68 in the rotating first transporting unit 74(B).

For example, at a stage where a sufficient amount of the developer is stored in the detection region in the first transporting path 72A, at that stage, the swingable member 64(B) operates as follows to detect the level of the stored developer.

That is, at the stage where there is a sufficient amount of developer, regardless of the position of the coaxial structure 744 of the non-transporting section 68 in the first transporting unit 74(B) that rotates in the detection region, as illustrated in FIG. 9A, the swingable member 64(B) swings to a position where the swing tip end portion 64*a* of the second portion 64*m* bent downward is in contact with the surface (S) of the developer.

Also, at this stage, the lower surface of the first portion 64*d* of the swingable member 64(B) does not come into contact with the coaxial structure 744 of the non-transporting section 68 in the rotating first transporting unit 74(B) until the developer storage level reaches a certain low level. In other words, until reaching a certain low level, the detection target plate 67 releases the blocking of the detecting unit 65.

Figure 11:
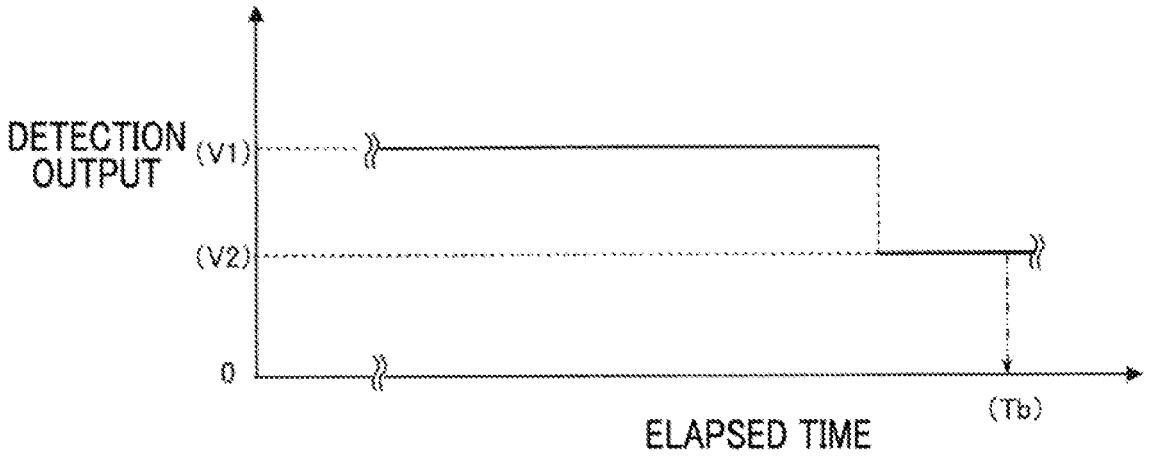
FIG. 11 is a conceptual diagram illustrating an example of a detection output of a detecting unit in the second exemplary embodiment.

At this time, as illustrated in FIG. 9A, the detection target plate 67 that swings in conjunction with the swingable member 64(B) swings to a position where the detection light in the detecting part 65*a* of the detecting unit 65 is blocked. Further, the detection output of the detecting unit 65 at this time is obtained as a predetermined first output value (V1) determined in advance as illustrated in FIG. 11.

The storage level detecting device 6 (or control unit 15) is set so that the detection output of the detecting unit 65 at this time is set to be handled as detection information that "developer is present".

On the other hand, at a stage where the developer stored in the detection region of the first transporting path 72A gradually decreases due to the supply operation, at that stage, the swingable member 64(B) becomes in the following state.

That is, at the stage where the developer decreases, the surface level (S) of the stored developer starts to become relatively low, so that the swingable member 64(B) in which the swing tip end portion 64*a* is in contact with the surface (S) and gradually starts to swing in the direction of lowering the swing tip end portion 64*a*.

At this time, when the amount of the developer decreases so that the level of the stored developer approaches the minimum detectable level MLow, as illustrated in FIG. 9B, the detection target plate 67 swings, in conjunction with the swingable member 64(B), to such a position that the detection light in the detecting part 65*a* of the detecting unit 65 is not blocked. Further, the detection output of the detecting unit 65 at this time is obtained as a predetermined second output value (V2) determined in advance as illustrated in FIG. 11.

At this time, as illustrated in FIG. 9B, in the swingable member 64(B), the lower surface of the first portion 64*d* is also in a state of swing in contact with the outermost circumferential portion of the coaxial structure 744 of the non-transporting section 68 in the first transporting unit 74(B) rotating in the detection region.

Here, even in this swing state, the swingable member 64(B) hardly swings so that the swing tip end portion 64*a* moves in the ascending direction. For this reason, the detection target plate 67 at this time in a state of remaining at a position where the detection light in the detecting part 65*a* of the detecting unit 65 is not blocked as illustrated in FIG. 9B. Further, the detection output of the detecting unit 65 at this time remains unchanged as the second output value (V2) as illustrated in FIG. 11.

In addition, in this storage level detecting device 6 (or control unit 15), for example, when the detection output of the detecting unit 65 at this time has reached a point in time (Tb) when a predetermined time has elapsed from the first output value (V1) to the second output value (V2) as illustrated in FIG. 11, it is set to be handled as detection information that "developer is insufficient or absent".

Therefore, according to the storage level detecting device 6, the level of the developer stored in the first transporting path 72A in the main body 70 of the developer supplying device 7 is detected without providing a space for storing and detecting a developer different from the first transporting path 72A, without extending the first transporting path 72A for the installation of the swingable member 64(B), and without obstructing the passage of the developer by the coaxial structure 744 in the detection region where the non-transporting section 68 of the first transporting unit 74(B) is present in the first transporting path 72A.

Modification Example

The present disclosure is not limited to the contents exemplified in the first and second exemplary embodiments, and includes, for example, the following modification examples.

In the first and second exemplary embodiments, although an example of a configuration in which the developer storage level detecting device 6 is applied as a storage level detecting device in the developer supplying device 7 in the image forming apparatus 1 is described, the storage level detecting device 6 of the present disclosure may be applied to other device components that transport and handle the developer.

For example, in a case where an image forming apparatus that forms an image made of a developer includes a main body having a transporting path through which a developer is transported; a developer transporting unit that is disposed to rotate in the transporting path and has a transporting section provided spirally around a rotating shaft; a storage level detecting device that detects the surface level of the developer being transported in the transporting path, the storage level detecting device can be constituted by the storage level detecting device 6 of the present disclosure.

Figure 12A:
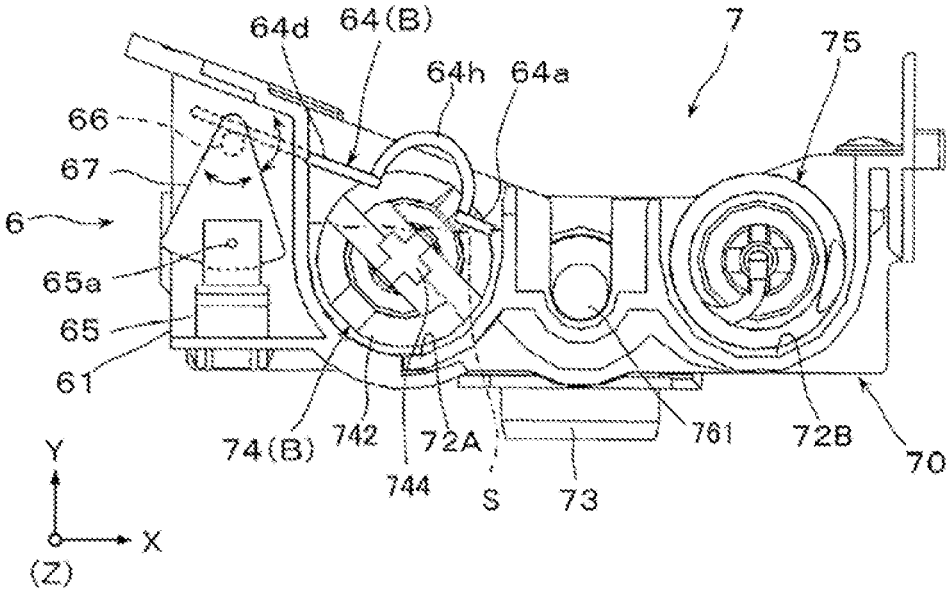
FIGS. 12A and 12B are schematic sectional views illustrating a modification example of the supplying device and the storage level detecting device according to the second exemplary embodiment.
Figure 12B:
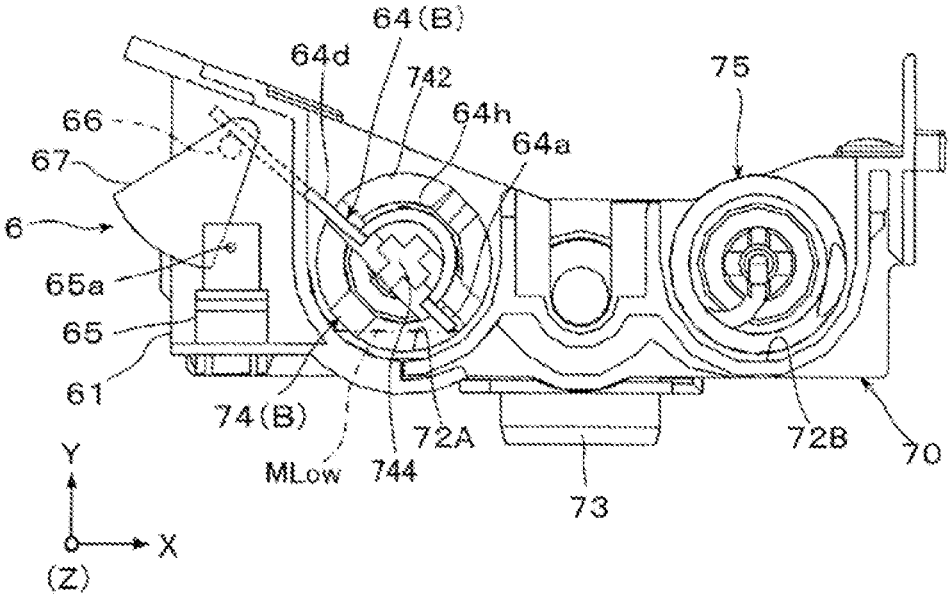

In the second exemplary embodiment, as the swingable member 64(B) having a bent shape, a configuration example in which the tip end portion side beyond the coaxial structure 744 of the non-transporting section 68 of the first transporting unit 74(B) is bent is described, but the swingable member 64(B) is not limited to this configuration, and for example, the swingable member 64(B) illustrated in FIGS. 12A and 12B may also be applied.

The swingable member 64(B) illustrated in FIGS. 12A and 12B is a swingable member having a curved portion 64*h* having an inverted U-shape between the first portion 64*d* and the swing tip end portion 64*a*.

In a case where the swingable member 64(B) with such a shape is used, as illustrated in FIG. 12(B), the swingable member 64(B), which follows the surface (S) of the stored developer, swings in the direction where the swing tip end portion 64*a* descends, when the amount of the developer in the first transporting path 72A decreases to a level approaching the minimum detectable level MLow, so that the surface (S) of the developer, of which the amount decreases to near the the minimum detectable level MLow, is detected with the curved portion 64*h* not coming into contact with the coaxial structure 744 of the non-transporting section 68 of the first transporting unit 74(B).

As the image forming apparatus 1, other types and kinds may be adopted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer storage level detecting device comprising:

a main body having a transporting path through which a developer is transported;

a developer transporting unit that is disposed to rotate in the transporting path and has a transporting section provided spirally around a rotating shaft;

a swingable member that comes in contact with a surface of the developer being transported in the transporting path and swings while following at least a level of the surface of the developer stored; and a detecting unit that detects a swing state of the swingable member, wherein the developer transporting unit has a non-transporting section without the transporting section, and the swingable member is disposed to swing in the non-transporting section.

2. The developer storage level detecting device according to claim 1, wherein in the non-transporting section, the rotating shaft forms an eccentric shaft with a shifted axial center.

3. The developer storage level detecting device according to claim 2, wherein the eccentric shaft has an eccentric shape that allows a swing tip end of the swingable member to reach a minimum detectable level of the surface of the developer when the swingable member comes in contact with the eccentric shaft.

4. The developer storage level detecting device according to claim 1, wherein in the non-transporting section, the rotating shaft has a coaxial structure with an axial center coincident with that of the rotating shaft.

5. The developer storage level detecting device according to claim 4, wherein the swingable member has a bent shape so as to reach a minimum detectable level of the surface of the developer beyond the coaxial structure in the non-transporting section.

6. The developer storage level detecting device according to claim 1, wherein the swingable member has a swing fulcrum located above an uppermost portion of the developer transporting unit.

7. The developer storage level detecting device according to claim 1, wherein the detecting unit is disposed outside the transporting path in the main body.

8. A developer supplying device comprising:

a main body including a receiving port that receives a developer supplied from a developer container, a transporting path through which the developer is transported, and a feeding port that feeds the developer in the transporting path to a supply destination;

a developer transporting unit that is disposed to rotate in the transporting path and has a transporting section provided spirally around a rotating shaft;

a feeding unit that feeds the developer in the transporting path to the feeding port; and a developer storage level detecting device that detects a surface level of the developer being transported in the transporting path, wherein the developer storage level detecting device includes the developer storage level detecting device according to claim 1.

9. The developer supplying device according to claim 8, wherein the developer storage level detecting device is disposed at a position that is downstream of the receiving port in the transport direction of the developer and close to the receiving port in the transporting path.

10. The developer supplying device according to claim 9, wherein the developer storage level detecting device is disposed at a position not directly below the receiving port in the transporting path.

11. An image forming apparatus comprising the developer supplying device according to claim 8.

12. An image forming apparatus comprising:

a main body having a transporting path through which a developer is transported;

a developer transporting unit that is disposed to rotate in the transporting path and has a transporting section provided spirally around a rotating shaft; and a storage level detecting device that detects a surface level of the developer being transported in the transporting path, wherein the storage level detecting device includes the developer storage level detecting device according to claim 1.

* * * * *